US005261864A

United States Patent [19]

Fitzpatrick

[11] Patent Number: 5,261,864

[45] Date of Patent: Nov. 16, 1993

[54] PHYSICAL EXERCISING APPARATUS

[76] Inventor: Patrick C. Fitzpatrick, 10 Penshurst, Old Harlow, Essex, Great Britain

[21] Appl. No.: 856,629

[22] Filed: Mar. 24, 1992

[30] Foreign Application Priority Data

Apr. 2, 1991 [GB] United Kingdom ..... 9106910

[51] Int. Cl.[5] ..... A63B 22/00

[52] U.S. Cl. ..... 482/52; 482/123; 482/130

[58] Field of Search ..... 482/52, 123, 130, 79

[56] References Cited

U.S. PATENT DOCUMENTS

| | | | |
|---|---|---|---|
| 118,740 | 9/1871 | O'Connor | 482/123 |
| 1,019,861 | 3/1912 | Titus | 482/123 |
| 3,687,450 | 8/1972 | Scholcmeyer | 482/123 |
| 4,645,204 | 2/1987 | Berger | 482/123 |
| 4,982,958 | 1/1991 | Ullman | 482/123 |

OTHER PUBLICATIONS

Stepshaper Manual, Aug. 1991 by Weslo, Inc.
Sutton, Washington Post Article, Sep. 24, 1990.
Stepshaper Brochure, Dec. 1991.
"How to Use Your Terry Body Trimmer".

*Primary Examiner*—Richard J. Apley
*Assistant Examiner*—Lynne A. Reichard
*Attorney, Agent, or Firm*—Mason, Fenwick & Lawrence

[57] ABSTRACT

Physical exercising apparatus comprising a ground-supported user platform adapted to permit step-up exercise and at least one elastic member one end of which is attached to the apparatus and the free end of which carries a user handle to enable a user to exercise by stretching the elastic member while supported at least in part on the platform.

7 Claims, 6 Drawing Sheets

PHYSICAL EXERCISING APPARATUS

DESCRIPTION

The invention relates to physical exercising apparatus.

It is known to provide a physical exercising apparatus in the form of a low ground-supported platform, commonly known as a step exerciser or stepper, which can be used for performing a variety of aerobic and anaerobic exercise.

It is an object of the invention to increase the versatility of such physical exercising apparatus while retaining its inherent virtues of simplicity, light Weight and compactness, since these virtues enable the apparatus to be manufactured and sold inexpensively, promote portability of the apparatus and facilitate storage of the apparatus when not in use.

According to the invention, physical exercising apparatus comprises a ground-supported user platform elevated to permit step-up exercise to a height and at least one elastic member one end of which is attached to the apparatus and the free end of which carries a user handle to enable a user to exercise by stretching the elastic member while supported at least in part on the platform.

Preferably the apparatus comprises a pair of elastic members disposed at opposite ends of the platform. If desired, several pairs of the elastic members may be provided and which are adapted to be used in the alternative or in combination to vary the effort which must be expended by the user during exercise. Preferably each pair of the elastic members will be of a different draw-weight. Thus a light draw-weight elastic member can be used for aerobic exercise while a heavy draw-weight elastic member can be used for anaerobic exercise. Usually, the elastic members will be in the form of bungee cords.

Preferably the elastic members are housed below the platform, and preferably they are trained over at least two pulleys or other guide members into a folded configuration whereby the effective length of each elastic member housed below the platform is increased to permit a range of extension sufficient to allow overhead exercise while standing on the platform. Preferably pulleys or other guide members are disposed at opposite ends of the platform for guiding the elastic members as they emerge from below the platform.

The user handle can be in any desired form e.g. a stirrup, a bar or a leg strap. When the handle is in the form of a bar it can be connected at its ends to the ends of a pair of elastic members so that the exerciser can be used to simulate weight training. Preferably the user handle will be readily detachable from the elastic member or members to enable alternative user handles to be attached.

Preferably the body of the apparatus will be constructed from plastics mouldings. If desired the mouldings may comprise a hollow cavity which can be filled, prior to use of the apparatus, with water, sand or the like as ballast to improve the stability of the apparatus during use. Preferably however the apparatus will be stabilised by the user during use using his or her own body weight.

The invention is diagrammatically illustrated by way of example in the accompanying drawings, in which.

Figure 5:
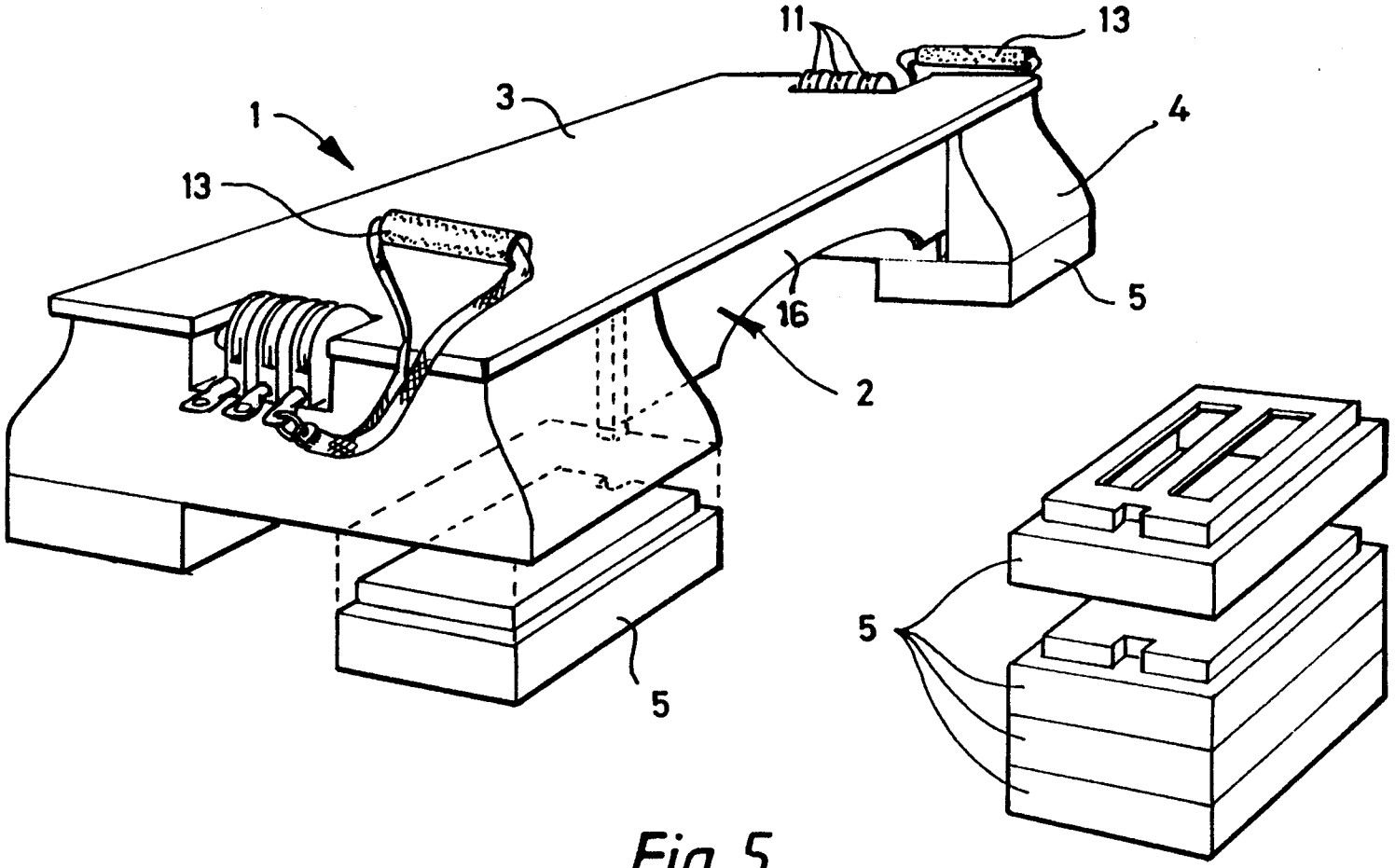
FIG. 5 is a perspective view similar to that of FIG. 1 but partially exploded, and showing how feet can be fitted to the step exerciser and how the feet can be stacked when not in use.

In the drawings a step exerciser 1 comprises a generally rectangular box-like enclosure or body 2, the upper surface 3 of which forms a horizontal platform or step, the body having ground engaging pedestals 4 at both ends. Preferably the body will be made from plastics injection mouldings as described more fully below with reference to FIG. 7. A shown in FIG. 5 the height of the exerciser may, if desired, be increased with the aid of spacer blocks or feet 5 which fit under the pedestals 4 in known fashion.

Figure 1:
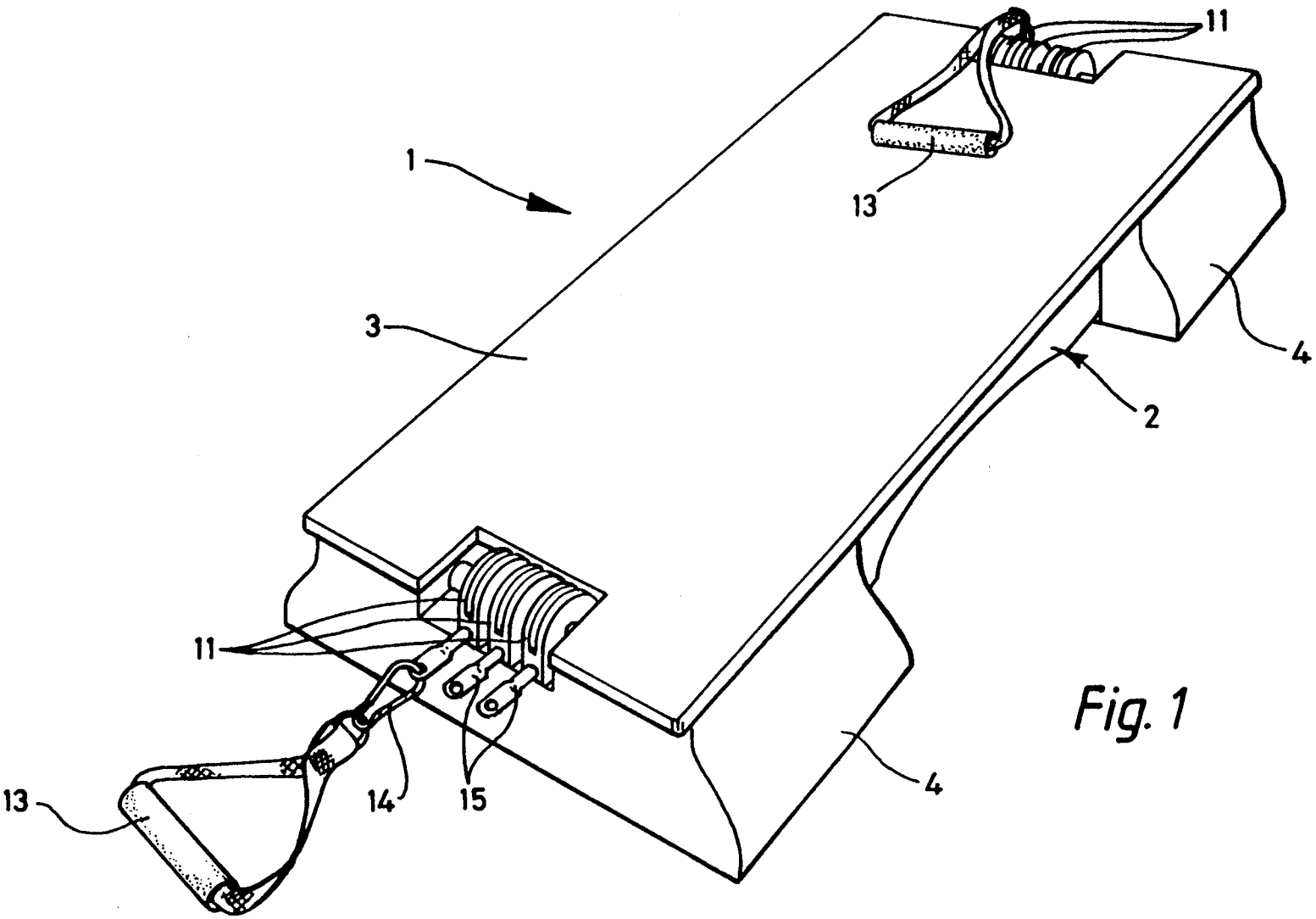
FIG. 1 is a perspective view of a step exerciser.
Figure 2:
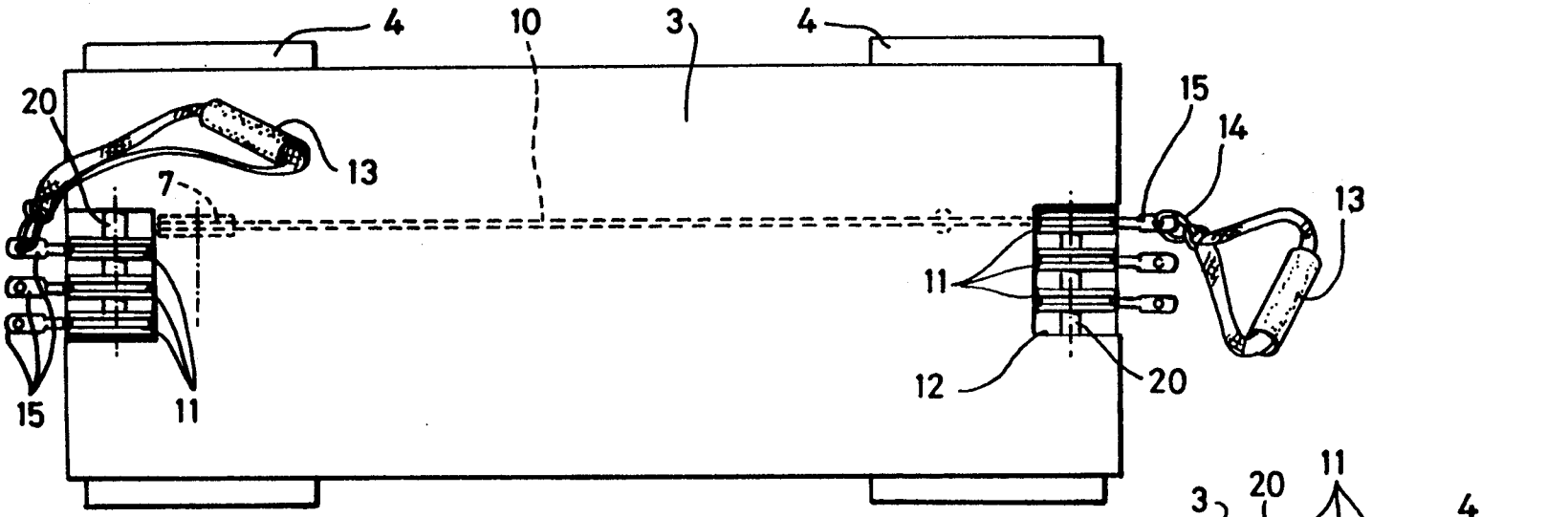
FIG. 2 is a plan view of the exerciser of FIG. 1.
Figure 4:
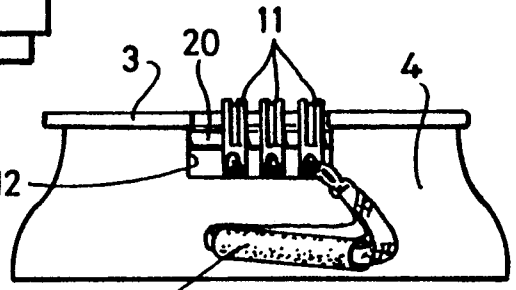
FIG. 4 is an end elevation of the exerciser.
Figure 3:
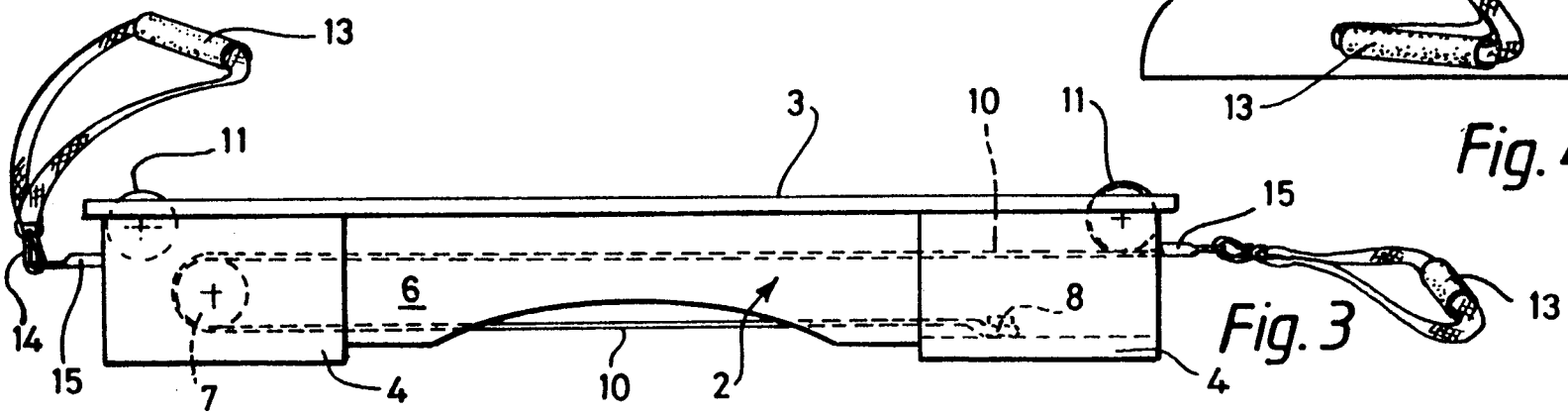
FIG. 3 is a sectional side elevation of the exerciser of FIGS. 1 and 2.

As indicated more clearly in FIG. 3 of the drawings the interior 6 of the body is hollow and mounted therein are lower sets of pulleys 7 mounted in the pedestals 4 adjacent to the opposite ends of the body. The ends of each of a series of elastic bungee cords 10 are fixed to the pedestals by fasteners 8 and the cords are trained around the pulleys 7 disposed at the end of the body opposite to the respective fixings 8 and are then trained over final guides in the form of upper sets of pulleys 11 mounted in the pedestals 4 and located in apertures 12 at the opposite ends of the platform so that the free ends of the bungee cords 10 emerge from the ends of the platform. The free ends of the bungee cords are provided with terminations 15 formed with apertures which receive clips 14 by which the cords can be attached to user handles 13 such as stirrups, bars or ankle straps to enable a range of different exercises to be performed as indicated in FIGS. 8*a* to *f*. Each of the four sets of pulleys 7 and 11 includes three co-axial pulley wheels. In the interests of clarity only one cord 10 (representative of a group of three such cords) is shown in FIG. 3, but it will be appreciated that in practice, an oppositely disposed group of cords will be trained about the other pair of pulleys 7 and 11 to emerge at the left-hand end of the platform as shown in FIG. 3.

As shown in the drawings groups of three bungee cords are provided at each end of the platform, each being of a different draw-weight to increase the versatility of the exerciser. Thus the cords may be used either singly or together by clipping the handle 13 to as many of the cords as desired.

Figure 6:
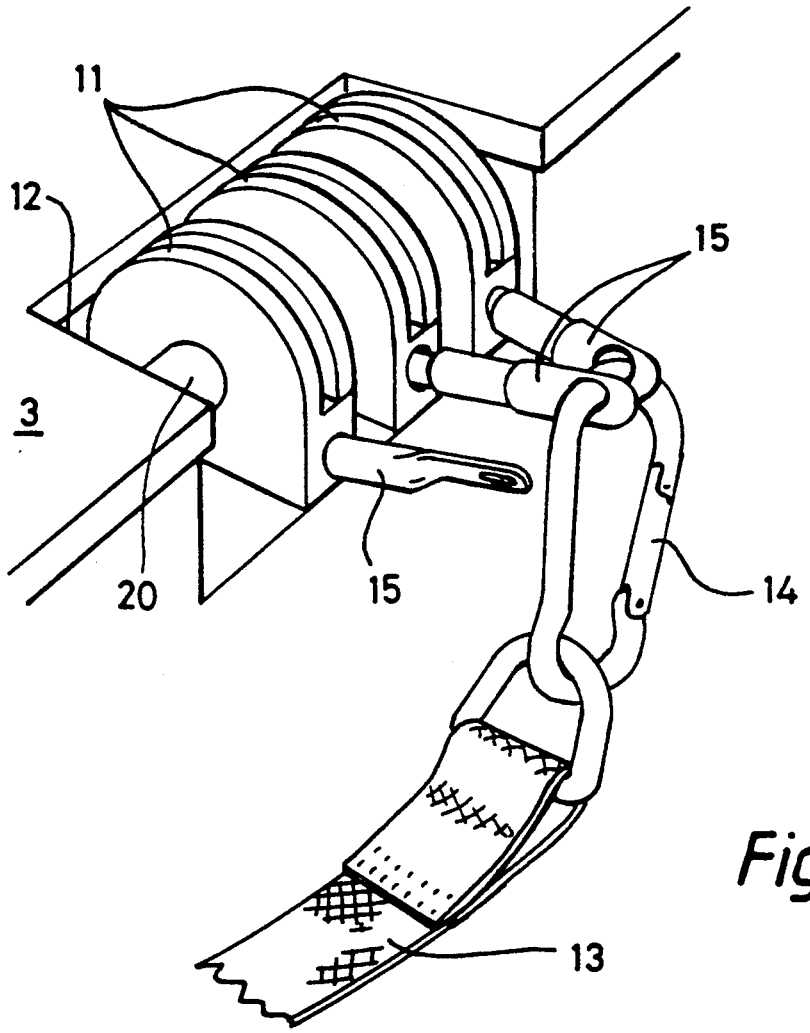
FIG. 6 is a scrap perspective view of one set of final guide pulleys for the bungee cords.

As shown in FIG. 6, the upper pulleys 11 capture the cords 10 in known fashion to prevent accidental displacement of the cords from the pulley systems during use.

Figure 7:
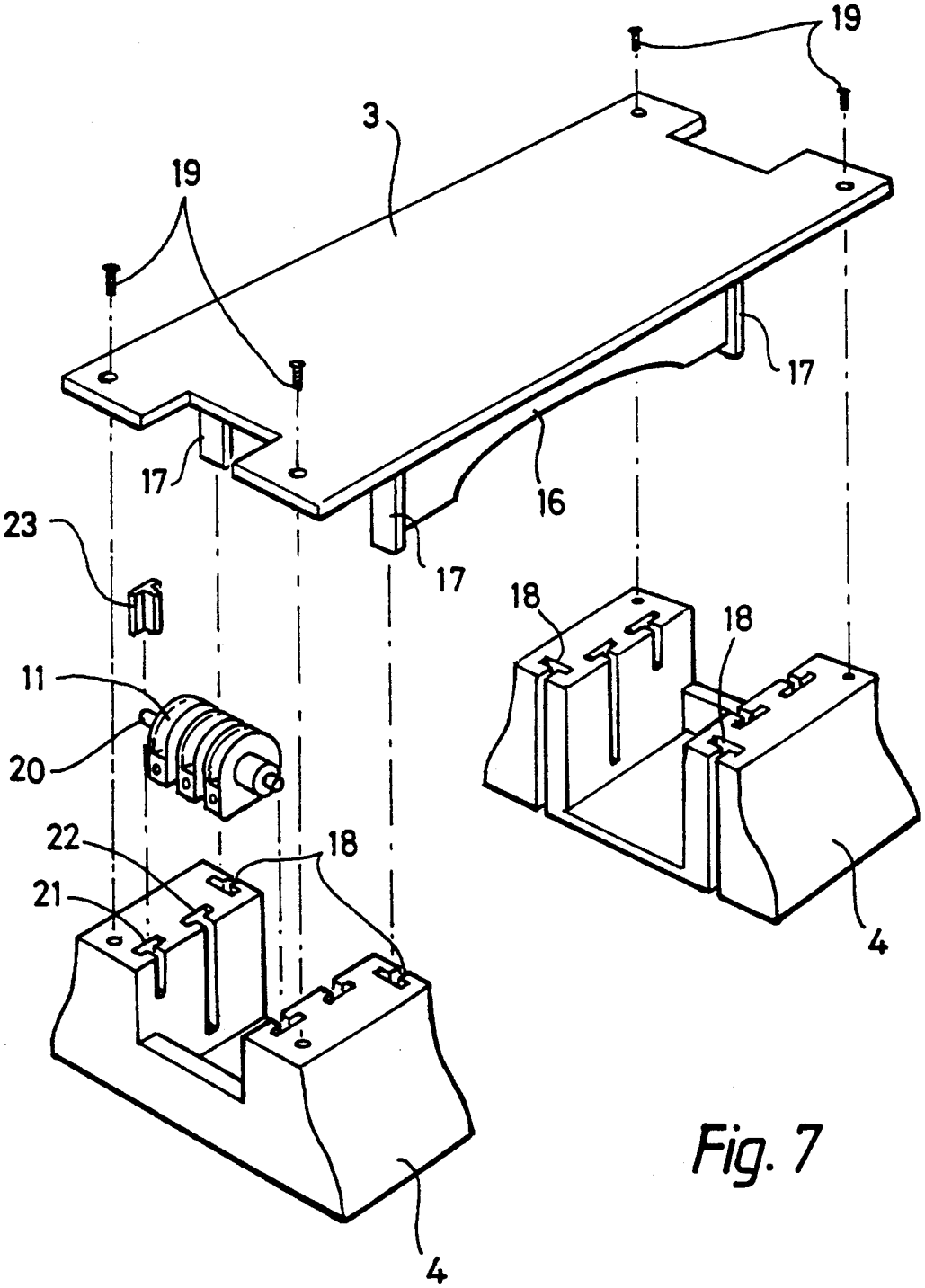
FIG. 7 is an exploded perspective view of the various components which make up the body of the step exerciser.
Figure 8A:
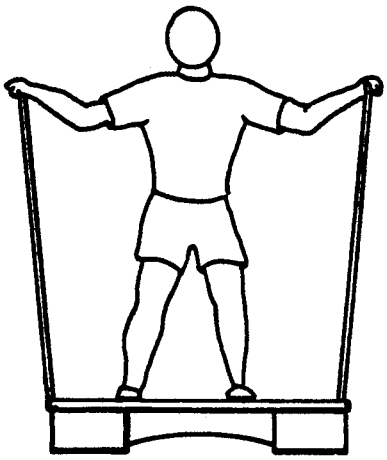
FIGS. 8*a* to 8*f* are diagrams illustrating various exercises which can be performed using the step exerciser of the invention.
Figure 8B:
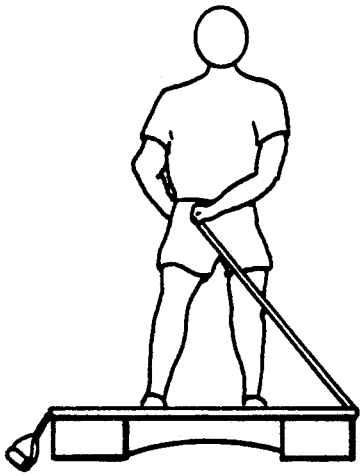
Figure 8C:
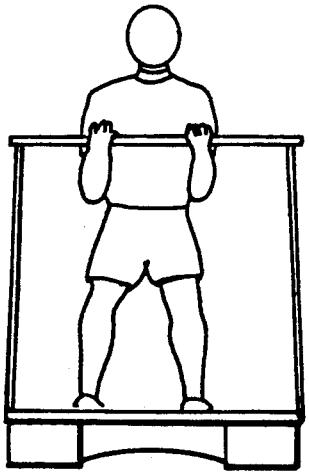
Figure 8D:
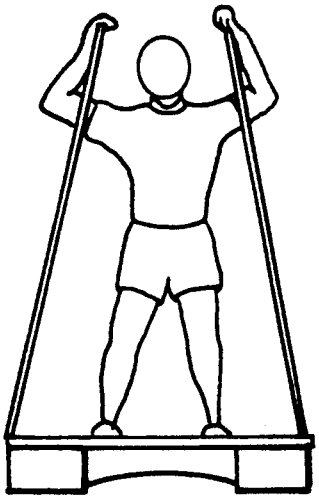
Figure 8E:
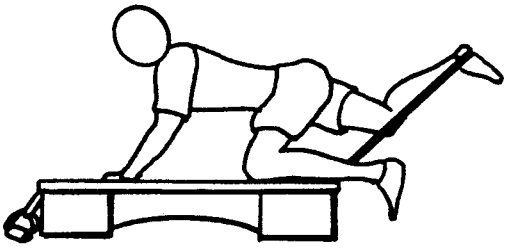
Figure 8F:
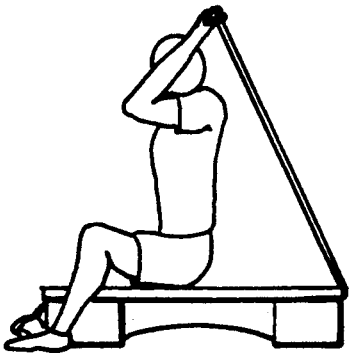

Referring to FIG. 7, the exerciser body is made from three main components, namely a moulding defining the upper portion including the platform 3 and two similar mouldings which form the pedestals 4. The platform moulding is formed on its underside with a parallel pair of longitudinally extending downwardly projecting stiffening flanges 16 which also serve the function of defining the box-like enclosure, the flanges being terminated at their vertical ends by cross flanges 17 adapted to fit in corresponding T-section slots 18 in the pedestals 4. The three mouldings can then be locked together by fasteners 19 e.g. self tapping screws which pass through bores in the platform 3 to engage the pedestals 4.

Each of the pedestals is generally U-shaped and is formed with opposite pairs of T-section slots 21 and 22 respectively which receive the ends of axle shafts 20 of the pulley sets 7 and 11 to mount the pulleys in position. The pulley axles 20 are prevented from moving along the slots 21 and 22 by T-shaped spacers or dowels 23 which fill the free space in the slots and are held in position by the lower surface of the platform moulding.

The invention thus provides a simple modification of a step-up exerciser which increases the versatility of such a device.

I claim:

1. Physical exercising apparatus comprising:

(a) a body comprising an upper portion defining a user platform having opposite ends;

(b) a ground engaging pedestal attached to the body at each end thereof and supporting said body at an elevation for step-up exercising;

(c) said body further comprising spaced flanges projecting downwardly beneath said user platform and extending between the pedestals to define a box-like enclosure;

(d) elastic cords each having a free end disposed at each of the opposite ends of the platform;

(e) a user handle on said free end of each of the elastic cords to enable a user to exercise by stretching the elastic cords while supported at least in part on the user platform;

(f) said enclosure having a portion of each elongate elastic cord extending therein;

(g) guides mounted on said apparatus below the level of said user platform;

(h) each elastic cord being trained over a said guide into a folded configuration;

(i) final guides disposed on the body at the opposite ends of the platform for said guiding elastic cords where they emerge from below the user platform; and (j) said pedestals having slots therein and said flanges having opposed ends shaped to interlock in said slots in the pedestals to secure the upper portion of the body and the pedestals together.

2. The physical exercising apparatus according to claim 1, and further comprising second elastic cords having a potion under the user platform and each having a free end at a said end of the platform for use with or alternatively to the first mentioned elastic cord having a free end at a said end of the platform, to thereby permit the user to vary the effort expended during exercise.

3. The physical exercising apparatus according to claim 2, wherein each of the second mentioned elastic cords is of a different draw-weight than the first mentioned elastic cords.

4. The physical exercising apparatus according to claim 1, wherein said guides are pulley wheels mounted on spindles journalled in the pedestals.

5. The physical exercising apparatus according to claim 1, and further comprising means for mounting the guides on the pedestals.

6. Physical exercising apparatus according to claim 1, and further comprising means securing a second end of each of the elastic cords to a selected pedestal.

7. Physical exercising apparatus comprising:

(a) a body comprising an upper portion defining a user platform having opposite ends;

(b) a ground engaging pedestal attached to the body at each end thereof and supporting said body at an elevation for step-up exercising;

(c) said body further comprising spaced flanges projecting downwardly beneath said user platform and extending between the pedestals to define a box-like enclosure;

(d) elastic cords each having a free end disposed at each of the opposite ends of the platform;

(e) a user handle on said free end of each of the elastic cords to enable a user to exercise by stretching the elastic cords while supported at least in part on the user platform;

(f) said enclosure having a portion of each elongate elastic cord extending therein;

(g) guides mounted on said apparatus below the level of said user platform;

(h) each elastic cord being trained over a said guide into a folded configuration;

(i) final guides disposed on the body at the opposite ends of the platform for said guiding elastic cords where they emerge from below the user platform; and (j) means for detachably connecting said body and said pedestals.

* * * * *